United States Patent [19]

Le Bail

[11] Patent Number: 4,563,969

[45] Date of Patent: Jan. 14, 1986

[54] SAIL HAVING VARIABLE PROPELLING AND LIFTING EFFECTS

[76] Inventor: Roland C. Le Bail, 80 Boulevard De Legenese B. P. 76, 56340 Carnac, France

[21] Appl. No.: 685,593

[22] PCT Filed: Mar. 5, 1982

[86] PCT No.: PCT/FR82/00038

§ 371 Date: Nov. 3, 1982

§ 102(e) Date: Nov. 3, 1982

[87] PCT Pub. No.: WO82/03053

PCT Pub. Date: Sep. 16, 1982

Related U.S. Application Data

[63] Continuation of Ser. No. 441,526, Nov. 3, 1982, abandoned.

[30] Foreign Application Priority Data

Mar. 11, 1981 [FR] France ..... 81 04814

[51] Int. Cl.[4] ..... B63H 9/04

[52] U.S. Cl. ..... 114/102

[58] Field of Search ..... 114/39, 102, 103; 244/DIG. 1.1, DIG. 1.2, 16; 280/213, 810; 180/2 A

[56] References Cited

U.S. PATENT DOCUMENTS 2,537,560 1/1951 Wanner ..... 244/DIG. 1
4,116,406 9/1978 Hamilton ..... 244/16

FOREIGN PATENT DOCUMENTS 1045610 1/1979 Canada ..... 244/16
2470725 6/1981 France ..... 114/103

*Primary Examiner*—Trygve M. Blix
*Assistant Examiner*—Jesûs D. Sotelo
*Attorney, Agent, or Firm*—Larson and Taylor

[57] ABSTRACT

A sail is provided having variable propelling and lifting effects. The sail can be used with a sailboard board, snow skis, ice and roller skates and more generally any sliding or gliding sports. The sail (1), which has a stable convex profile in the shape of gull wings, is constituted by a fabric in the shape of a sector of a circle provided with two transparent windows (2) and held taut on a framework of light alloy tubes comprising two edge tubes (3) fitted in a curved front tube (4), slightly bent central tube (7) serving to form a "V" by the action of two strut tubes (5) on the connection (12) and a curved support tube (6). The sail is held taut by a "Velcro" device at the wing ends (9) and by pre-bent slats (8) also held in position by a "Velcro" device (10). Because the forces are presented on a single windward side, the sail can be constructed from rigid material so as to still further increase the aerodynamic efficiency.

11 Claims, 5 Drawing Figures

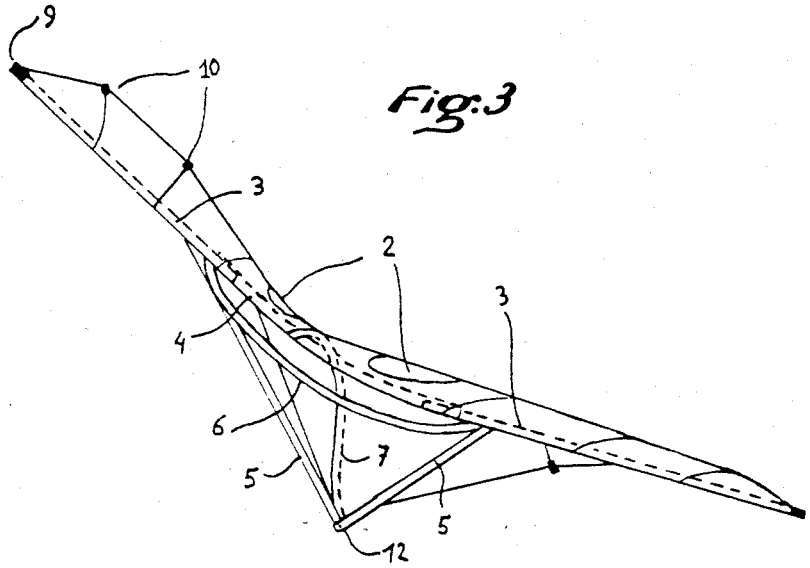
Fig:3
Fig:4
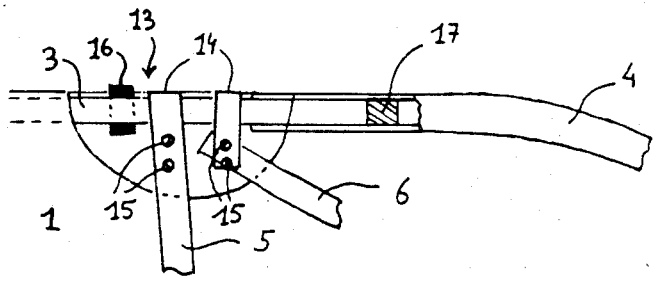
Fig:5
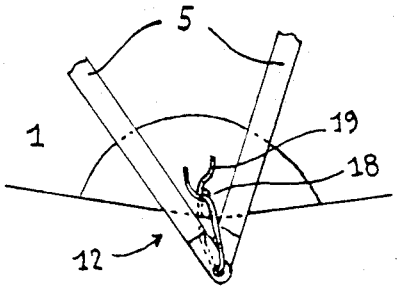

SAIL HAVING VARIABLE PROPELLING AND LIFTING EFFECTS

This application is a continuation of application Ser. No. 441,526, filed Nov. 3, 1982, now abandoned.

The present invention relates to a new type of sail for machines such as sailboards, sail carts, and sailing boats and more generally for any gliding or sliding sports such as for example skiing and ice and roller-skating.

The sails employed at the present time have for feature, irrespective of their shape, to take advantage of the force of the wind by pivoting about a vertical axis; the propelling component is then perpendicular to this axis.

A number of patents which disclose new sails capable of being adjusted in three dimensions have been filed. The oldest patent and without doubt that which best discloses the characteristics of these new sails is that filed by Rudow Rummler on Jan. 14, 1935, in the U.S.A. and having U.S. Pat. No. 2,170,914. FIGS. 1 to 10 of this patent are in particular very explanatory. Two other U.S. patents, namely U.S. Pat. No. 3,455,261 to Hugh Perrin, filed on May 15, 1968, discloses a kite sail in FIGS. 1 to 5, and U.S. Pat. No. 3,924,870 to Spivack filed on Dec. 9, 1975, discloses an ice-skating sail. A French Pat. No. 2,173,389 filed by Jean-Paul Lenoble in February 1972 again uses with many details and some particular arrangements essentially the same principles of the sail already well-described in the U.S. patent to Rudow Rummler. Another, U.S. Pat. No. 4,077,345 to Grey M. Gurley filed in March 1978, discloses a particular arrangement of the preceding type of sail in that it is oriented about an oblique axis fixed in the front of a boat. A German Pat. No. 2,833,616 filed by Gunter M. Voss in February 1980 relates to a specialised sail for sailboarding.

The present sail is of this new type of sail capable of being oriented about three axes so as to obtain at will propelling and lifting effects. However, in contrast to all the aforementioned patents all of which described sails having a transversely concave shape, the sail proposed by the present patent is characterised by a stable transversely convex shape of the gull-wing type. Indeed, a concave profile always has a tendency to turn round in a strong wind since if its position of equilbrium is departed from, in which position the two halves of the sail offer the same area perpendicularly to the wind, one of the halves receives more and more wind while the other receives less and less wind as opposed to a "V" convex profile which always tends to return the sail to its position of equilibrium. Further, a "V" convex profile facilitates the flow of the air, and in squalls it has a tendency to close and consequently absorbs sudden changes in the wind.

Advantageously, the sail has a rearwardly divergent leading edge, a highly curved windwardly concave central section in the vicinity of the apex of the leading edge and extending in a progressively more rectilinear manner toward the rear end, and a trailing edge which joins the two ends of the leading edge at said rear end so as to form two "V" divergent windwardly convex areas on each side of said central section. The apex of the leading edge is preferably rounded and its angle of opening is preferably of the order of 110° to 130°.

The central section may be slightly convex and its rear end may have a dissymmetrical "S" shape.

The sail may have a supporting element spaced from the sail under the latter and two stays which forwardly diverge from said rear end and form for example an isoceles triangular system with the support bar.

Preferably, the sail comprises a frame of substantially rigid, in particular tubular, elongated elements, and a sail cloth held taut on the frame with preferably an assembly of windwardly concave pre-bent slats close to the leading edge. The connections between the frame elements may be advantageously flexible in order to facilitate a certain deformability of the sail, the shape of which is maintained by its own tension.

In order to describe well a possible assembly of the sail, it is shown at three angles:

FIG. 3 is a front view with a small rotation of the sail and

FIGS. 4 and 5 are views of details.

Figure 1:
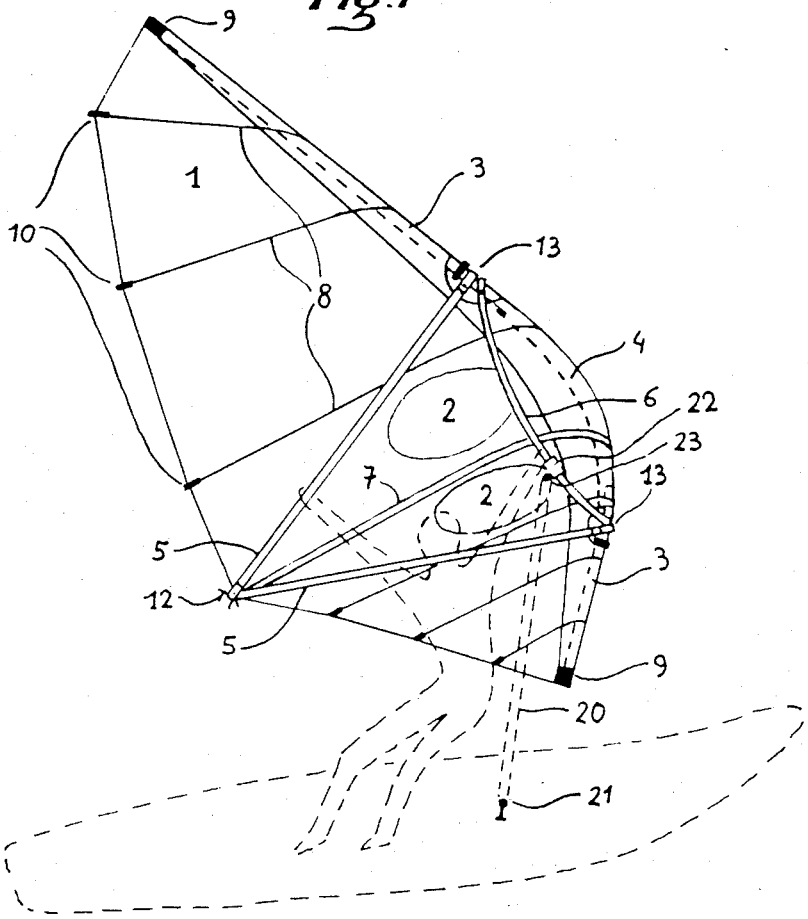
FIG. 1 is a side view from below.
Figure 2:
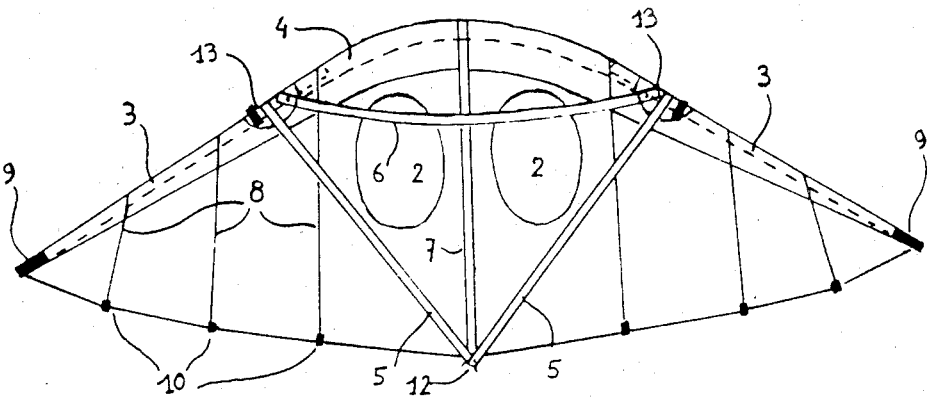
FIG. 2 is a bottom plan view.

The sail 1 having a stable convex profile in the shape of gull wings comprises an assembly of trapezoidal portions of fabric sewn together and imparting thereto the general appearance of a sector of a circle and provided with two transparent windows 2 providing the operator good visibility. The sail 1 is held taut on a frame of light alloy consisting of: two edge tubes 3 fitted in a curved front tube 4, a central tube 7 which is slightly bent in accordance with an "S" shape and serving to form the transverse "V" convex profile by the action of two strut tubes 5 on the connection 12 and finally a curved support tube 6. The stiffening of the fabric and the maintenance of the fitting of the edge tubes 3 in the curved front tube 4 are achieved by pulling on the sleeves containing these edge tubes and closing the "Velcro" devices 9 at the ends of the wing. "Velcro" is a trademark designating self-adhering textile strips which allow repeated and rapid openings and closures. The sail 1 is also held taut in the longitudinal direction by the pre-bent slats 8 which are held in position by "Velcro" devices 10 which, in combination with the sleeves containing the tubes 3 and 4, give to the assembly a good penetration in air. FIG. 4 shows the detail 13: the edge tubes 3 pass inside leather strips, respectively held fast to the strut tubes 5 and the support tube 6 by means of screws 15, before being fitted inside the curved front tube 4 by bearing against the stops 17; the rings 16 maintain the tubes 5 and the tube 6 in position. The detail 12 in FIG. 5 shows the tightening of the sail by means of cords 19 which pass through the eye 18.

The sail may be employed alone or optionally connected to a mast 20 of the machine to be propelled. The mast 20 may be for example connected to the machine by a first ball-joint 21 while the other end is connected to the sail by a sleeve 22 which slides along the support bar 6 with a second ball joint 23.

In the case of the use of the sail for a jumping-board in respect of which the feet are attached to the board by small bands of synthetic fabric fixed to the board, the jump is effected merely by retraction of the legs and, in contrast to the conventional sails, the travel of the machine may continue without jarring since the sail remains constantly in the propelling position.

A characteristic of the new sail is that it receives the wind only on one side, the other side always being leeward. This feature is very important since it permits the use of pre-formed sails of rigid materials with aerodynamic profiles of the aircraft wing type.

Tacking is carried out by hauling in the sail followed by the passage of the latter over the head of the operator with an immediate taking-up of the wind on the other side; this technique is much more easy and rapid than the conventional manner of tacking by tilting the mast rearwardly and the passage of the operator in front of the mast, as occurs with the present sailboarding sails.

The multiple possible orientations of the sail permit the creation of a propelling force which has for effect to pull the machine forwardly and upwardly and this lift, which varies with the desired size of the sail, should moreover permit high speeds to be reached due to the resulting aquaplaning effect on light machines.

I claim:

1. A navigational sail device comprising:

an elongate front member;

a sail secured to said front member along the length thereof;

a plurality of prebent slats incorporated in the sail at laterally spaced locations and extending transversely to said front member, said slats being curved in the region of the front member so as to permanently support the sail in a windwardly concave shape in the region of the front member along the length of the front member;

a generally triangular manipulation device for manual control of said sail device during operation comprising a pair of elongate members connected together at one end and spaced apart at the other end thereof by an elongate connecting member forming the base of the triangle, said manipulation device being secured, at the apex of the triangle formed at said one end of said pair of elongate members, to the trailing edge of the sail centrally thereof, and said pair of elongate members being connected to the front member at the said other ends thereof.

2. A navigational sail device as claimed in claim 1 wherein said front member is of three piece construction including a central portion and two lateral portions.

3. A navigational sail device as claimed in claim 2 wherein said portions of said front member comprise elongate tubular elements.

4. A navigational sail device as claimed in claim 2 wherein said central portion of said front member is curved.

5. A navigational sail device as claimed in claim 2 wherein said central and lateral portions of said front member are detachably fitted together to form said front member and rapid closure means are used in connecting the sail to the front member so as to provide rapid assembly and disassembly of the sail.

6. A navigational sail device as claimed in claim 1 wherein said sail includes windows therein.

7. A navigational sail device as claimed in claim 1 wherein said elongate members of said navigational device comprise tubular elements.

8. A navigational sail device as claimed in claim 1 further comprising an elongate centrally located member of windwardly concave shape in the region of said front member and of slightly convex shape at the trailing end thereof so as to be of an overall assymetrical "s" shape.

9. A navigational sail device as claimed in claim 1 wherein said front member comprises a three part member comprising a central curved tube and a pair of substantially straight laterally extending tubes fitted together with said central tube.

10. A navigational sail device as claimed in claim 9 wherein the angle defined between the ends of said central curved tube is between approximately 110° and approximately 130°.

11. A navigational sail device as claimed in claim 1 wherein said elongate members of said navigation device form an isosceles triangle wherein the equal sides are substantially straight.

* * * * *